US005552183A

United States Patent [19]

Killar

[11] Patent Number: 5,552,183

[45] Date of Patent: Sep. 3, 1996

[54] PROCESS FOR COATING OR PRINTING A PLASTIC FILM WITH WATER OR SOLVENT-CONTAINING COATING AGENTS OR MIXTURES THEREOF, U/V-CURABLE PAINTS OR INKS AND PVC PASTES

[75] Inventor: Erich Killar, D-8067, Petershausen, Germany

[73] Assignee: Erich Killar, Petershausen, Germany

[21] Appl. No.: 325,450

[22] PCT Filed: Apr. 23, 1993

[86] PCT No.: PCT/DE93/00365

§ 371 Date: Jan. 6, 1995

§ 102(e) Date: Jan. 6, 1995

[87] PCT Pub. No.: WO93/22072

PCT Pub. Date: Nov. 11, 1993

[30] Foreign Application Priority Data

Apr. 24, 1992 [DE] Germany ..... 42 13 582.6

[51] Int. Cl.[6] ..... B05D 3/00; B05D 7/00

[52] U.S. Cl. ..... 427/271; 427/273; 427/374.1; 427/402

[58] Field of Search ..... 427/273, 148, 427/149, 372.2, 374.1, 378, 398.2, 434.2, 271, 261, 265, 316, 294, 296, 402

[56] References Cited

U.S. PATENT DOCUMENTS 2,590,290 4/1952 Chavannes ..... 154/97.5
4,302,489 11/1981 Hattori et al. ..... 427/273
4,442,560 4/1984 Van Wersch et al. ..... 118/257

FOREIGN PATENT DOCUMENTS 3729450 9/1987 Germany .
266078 2/1950 Switzerland .
2050942 2/1981 United Kingdom .
2100191 12/1982 United Kingdom .

*Primary Examiner*—Shrive Beck
*Assistant Examiner*—Fred J. Parker
*Attorney, Agent, or Firm*—Hill, Steadman & Simpson

[57] ABSTRACT

For coating or printing plastic films with hydrous coating agents, solvent-containing coating agents or mixtures thereof, UV-curable lacquers or inks as well as PVC pastes and, in particular, for printing with water soluble inks, the foil is deposited on a substrate in order to avoid excessively long drying paths and in order to enable the adherence to an exact print repeat, and said film is heated until an adhesion has been produced, is subsequently cooled while remaining on the substrate, is coated or, respectively, printed while remaining to adhere to the substrate, is subsequently dried and, finally, is cooled and removed from the substrate. The adhesion of the film on the substrate established after the formation of the adhesion is thereby also preserved after the cooling before the coating or printing.

29 Claims, No Drawings

PROCESS FOR COATING OR PRINTING A PLASTIC FILM WITH WATER OR SOLVENT-CONTAINING COATING AGENTS OR MIXTURES THEREOF, U/V-CURABLE PAINTS OR INKS AND PVC PASTES

BACKGROUND OF THE INVENTION

The present invention generally relates to methods for coating or printing plastic foils or films.

The invention is particularly directed to the coating or printing of a plastic film with hydrous or, respectively, aqueous coating agents, solvent-containing coating agents such as ethanol, methanol, isopropanol, xylol, 1-butanone, methyl ethyl ketone, dimethylformamide, methyl glycol acetate and tetrahydrofuran or mixtures of aqueous coating agents and solvent-containing coating agents, UV-curable lacquers or inks as well as PVC pastes. The invention is particularly directed to a coating of a plastic film with a hydrous coating agent, particularly printing with a water-soluble ink.

The invention is also directed to the coating and printing of the plastic film by way of transfer printing comprising the work steps of coating the conveyed ribbon with hydrous coating agents, solvent-containing coating agents or mixtures thereof, UV-curable lacquers or inks, of drying the applied agent or the applied ink, of depositing the film onto the coated or printed tape, laminating the film upon application of heat (160°–200° C.) and pressure and thereafter cooling and separating the plastic film from the conveyor belt.

The invention, finally, is directed to a method for coating a substrate such as tricot, fabric, fleece or felt by way of transfer coating comprising the following work steps:

a) coating an endless conveyor belt with aqueous coating agents, solvent-containing coating agents or mixtures of aqueous and solvent-containing coating agents as well as PVC pastes;

b) drying the applied agent;

c) cooling the agent via cooling drums;

d) re-coating with the aforementioned coating agents (see step a));

e) potentially laminating a substrate such as tricot, fabric, fleece or felt into the as yet wet material;

f) drying and jelling upon application of heat up to 200° C.;

g) cooling the laminate and removal thereof from the conveyor belt.

Great quantities of plastic films in the manufacture of data carrier tapes such as, for example, audio and video tapes are already coated with solvent-containing and, in particular, with hydrous coating agents that contain the critical particles for the data storage. The plastic films are thereby conducted over drum straighteners and dare only be heated to comparatively low temperatures due to the shrinkage. These low temperatures require extremely long drying paths, for example up to more than 160 m, for effective drying of the coating agent.

There is therefore a great need for a faster drying capability and for lowering manufacturing costs of the tape coating systems and, thus, of the data carrier tapes.

German published application 37 29 450 discloses a method for double-sided coating of a film tape, whereby two tapes are joined to one another at their edges, these then running through a coating tape as sandwich or laminate, whereupon a treatment of the coated layer ensues and, finally, the two tapes joined to one another only at their edges are in turn separated from one another in that the connecting edges are cut off, so that two tapes coated at one side are ultimately present as final product according to German published application 37 29 450.

German published application 36 05 426 discloses a method for surface-processing of polyethylene films. An ink is applied onto a printed film that is applied on a carrier of metal or paper. When transferring the printed film onto a polyethylene film, this is in turn pulled off from the carrier material.

German AS 11 82 560 discloses a method for manufacturing packaging materials of water-sensitive films by coating with aqueous dispersions, whereby two webs of the films pass a nip into which the dispersion is introduced, and the films are in turn separated when they depart the nip.

Solvent-containing inks are usually employed when printing plastic films, this involving ever greater problems in view of the elimination or, respectively, reclamation of the solvents occasioned by stricter and stricter environmental regulations.

There is therefore an increasing need here for printing plastic films with inks that are free of solvent, i.e. for example, with water-soluble ink or with hydrous agents, i.e. mixtures of aqueous coating agents and coating agents that contain solvent.

The employment of water-soluble inks called for in and of itself, however, has hitherto presented difficulties since the required color fastness leaves a great deal to be desired, namely regardless of the printing technique employed.

SUMMARY OF THE INVENTION

The invention is therefore based on the object of making a method available for coating or printing a plastic film with aqueous coating agents, solvent-containing coating agents or mixtures of aqueous and solvent-containing coating agents, UV-curable lacquers or inks as well as PVC pastes that are suitable for silkscreening, flexographic printing, rotogravure and offset printing and is also suitable for coating and lacquering, including lamination, and which avoids long drying paths upon observation of an exact printing repeat. In particular, plastic films should be coated or printed with hydrous coating agents.

Finally, a method for coating a substrate by way of transfer coating should be recited that allows a qualitatively usable coating and avoids long drying paths.

This object is inventively achieved by the work steps recited in claim 1 as well as by the work steps recited in claim 21.

Advantageous embodiments of the method of the invention are recited in the subclaims.

In a preferred embodiment according to claims 14 and 15 is directed to the coating and printing of a plastic film is achieved by way of transfer printing. This method is characterized by the following work steps:

a) coating the conveyor belt (in the cold condition) with the coating agents: aqueous coating agent, solvent-containing coating agent or mixtures thereof, UV-curable lacquers or inks;

b) drying the applied agent or the applied ink with heat or UV;

c) depositing the film on the as yet hot, coated or printed tape (given UV products, the tape must be heated);

d) laminating the film under the influence of heat, i.e. temperatures of 160°–250° C., in particular 180° C.; and e) cooling and separating the plastic film from the conveyor belt.

When the plastic film is to be coated with a PVC paste by way of transfer coating, then the cold conveyor belt in a specific embodiment is coated with a PVC paste. This paste then gels; the film is laminated on, cooled, separated and wound up.

When a substrate such as tricot, fabric, fleece or felt or the like is to be coated by way of transfer coating, then, according to an alterative embodiment of the invention, an endless conveyor belt that can be treated with release agents is coated with aqueous coating agents, solvent-containing agents or mixtures of aqueous and solvent-containing coating agents as well as with PVC pastes, the applied agent is dried, the agent is cooled via cooling drums and is again coated with the aforementioned agents. A substrate such as tricot, fabric, fleece or felt is subsequently laminated on into the as yet wet material and dries and gels under the influence of heat up to 200° C. The cooling and separation of the laminate from the conveyor belt again ensues as final step.

DETAILED DESCRIPTION OF THE INVENTION

It has now been surprisingly found that inks, lacquers and coatings can be thermally bonded to the film at temperatures of 200° C. and above with the method of the invention. The film thereby has an adhesion of 150 N/5 cm. The printing speed can amount to up to 350 m/Min. Such a quality and quantity were hitherto incapable of being achieved with the methods of the prior art. It is also advantageous that the method of the invention is environmentally safe given utilization of water-soluble agents. Finally, work can be carried out as well with standard, solvent-containing inks, lacquers, pastes and UV-curable products, whereby long drying paths are avoided. It is also advantageous that a climate control of the work rooms is no longer required. Various printing processes in line, coating, lacquering and laminating and embossing are now possible. The tension due to the conveying of the film is now eliminated, as a result whereof a smoother course of the film arises, i.e. fluttering of the film and shrinking of the film no longer occur. A faultless repeating and doctoring now derives due to the method of the invention. Inventively, films having a thickness of 0.01–0.5 mm can be printed, lacquered, coated, laminated and stamped.

A high-grade surface processing can thus be achieved with the inventive printing of web-shaped materials. The inventively coated or printed films can be utilized, for example, for manufacturing furniture films, decorative films, adhesive films, cover films, artificial leather, PVC wallpaper and for manufacturing floor coverings.

When the film or coating lying on the tape is to be embossed, then a shagreened or embossed, circulating belt for embossing films and coatings can be utilized according to a preferred embodiment. In this embodiment, an unprinted or printed film, web of goods can be applied onto the embossed belt and can be hauled off toward the rear, as known. One proceeds such in this embodiment that the film or web of goods or coating lying on the smooth conveyor belt is blown or drawn with vacuum or mechanically transferred onto an embossed belt and is then embossed and hauled off toward the rear, as known. The film or the coating can be printed, coated or embossed from the front side or from the back side. A person skilled in the art knows that films or coatings can also be embossed without pressure.

According to this embodiment, the film or coating can optionally be directly laminated onto a shagreened or embossed, circulating conveyor belt.

The method of the invention substantially facilitates work since a draw-in of leaders and trailers as well as a draw-in means are eliminated.

The method of the invention can be implemented in a simple way. A heat-resistant, driven, continuously circulating special belt of aramide, polyamide or polyester mixed fabric as well as fleeces and felts or the like that can be equipped with a release layer is utilized in a printing or, respectively, coating system. All commercially obtainable release agents such as silicone, PTFE, (Teflon®) and the like serve as release agent.

The conveyor belt can contain a coating such as a hard rubber coating or, respectively, can contain a coating of commercially obtainable thermal plastic polymer in another embodiment.

The film to be coated or to be printed is laminated onto the above-described, circulating, heat-resistant special conveyor belt. This laminate is printed or coated. After cooling the composite web, the film is separated and wound up in a standard way.

When a plastic film is hauled off from a supply reel, stresses that can lead to a buckling of the film prevail in the inside thereof insofar as counter measures are not undertaken. It is therefore necessary to first overcome these stresses and, moreover, to see to it during printing that the film can be exactly guided in view of the desired arrangement of the printing format or, respectively, of a desired print repeat. The measure of depositing the plastic film on a substrate and heating the film for the creation of an adhesion serves this purpose. The heating of the plastic film thus initially serves the purpose of relaxing the internal stresses and, moreover, serves the purpose of achieving the adhesion as a consequence whereof the film adheres to the conveyor belt in anti-slip fashion.

The film heated in such a way and for said purpose must be cooled before the coating, as a result whereof the previously achieved adhesion of the film on the conveyor belt is not deteriorated, as tests have shown. In the next work step, thus, the plastic film can, for example, be coated with a hydrous medium or, respectively, can be printed with a water soluble ink while adhering to the conveyor belt, after which the applied agent or, respectively, the printed ink must be dried.

In view of the necessary rapidity during the overall method, this drying can only be achieved by way of a not inconsiderable heating. This heating, on the other hand, assures the reaction of particles of the agent or, respectively, of the ink with particles of the surface of the plastic film, a good solidity of the coating or, respectively, of the printing format being simultaneously achieved as a result thereof.

The possibility of coating or, respectively, printing plastic films with aqueous coating agents, solvent-containing coating agents or mixtures of aqueous and solvent-containing coating agents, UV-curable lacquers or inks as well as PVC pastes is thus in fact achieved overall by the method of the invention. In particular, hydrous agents or, respectively, water soluble ink should be utilized, namely in such a way that great quantities of film can be coated or, respectively, printed with traditional coating or, respectively, printing units in practically all traditional coating or, respectively, printing techniques while simultaneously achieving the best coating or, respectively, priming quality and durability of the coating or, respectively, of the printing.

All organic solvents, particularly ethanol, methanol, isopropanol, xylol, one-butanone, ethyl methyl ketone, DMF, methyl glycol acetate and THF, can be utilized as solvent-containing agents. An example of a solvent-containing ink derives from the following formula:

90 parts solvent: methyl ethyl ketone (30 parts), methyl glycol acetate (30 parts), THF (10 parts), xylol or toluol (30 parts), 10 parts pigments and carriers viscosity: 20 seconds in a Ford cup with 4 mm nozzle (for rotogravure and flexographic printing)

viscosity for silkscreening: approximately 30,000 cP.

The ink, however, can also be a water soluble ink. For example, such an agent is composed of 90 parts water with 10 parts binder and colorant. The viscosity of this aqueous coating agent amounts to 20 seconds in a Ford cup with 4 mm nozzle. In another embodiment, the coating agent can also represent a mixture of aqueous agents and solvent-containing agents. For example, a hydrous coating agent contains 85 parts water and 5 parts isopropanol and 10 parts binder and colorant.

Pastable E-PVC and S-PVC types, i.e. all commercially standard PVC types can be utilized in PVC pastes (plastisols).

All commercially standard inks and lacquers can be utilized as UV-curable lacquers or inks.

What are referred to as photoinitiators are contained in these UV-curable lacquers or inks, these photoinitiators being cracked by ultraviolet light and then effecting the radical and cationic polymerization of the binding agent. The UV-curable lacquers are thus cured by ultraviolet radiation, whereby ultraviolet radiator, binding agent and photoinitiator must be well-matched to one another.

The work steps of the invention can be advantageously multiply repeated in toto, so that, for example, different inks can be successively printed when printing.

The implementation of a first part of the heating immediately before deposit on the substrate is expediently recommendable for the heating required to release the stresses prevailing in the film hauled off from a large reel and for achieving the adhesion of the film. In this case, a heating of the film proceeding from its side to be coated or, respectively, to be printed comes advantageously into consideration for simplifying the heating step.

On the other hand, however, the first part of the heating of the plastic film can also already be chronologically postponed to such an extent that this part of the heating process occurs only after the deposit of the film on the substrate. The film in fact then enters onto the substrate with the internal stresses; since, however, it does not yet exhibit any adhesion, it can still "slide" on the substrate when the internal stresses thereof are released as a consequence of the heating until the internal stresses of the film have been canceled by the heating; the laminating ensues subsequently.

The at least partial heating of the plastic film after being deposited on the substrate offers the possibility of advantageously supplying the necessary heat to the film by absorption from the substrate. For example, the substrate can thus be composed of a correspondingly heated conveyor belt.

The temperature required for achieving the adhesion of the plastic film is usually a temperature that is too high for the actual coating or, respectively, printing process, for which reason a cooling of the film is to be provided in a next method step. This cooling should expediently ensue from that side of the film to be coated or, respectively, to be printed. The cooling can be limited to a minimum as a result thereof.

After the coating or, respectively, printing of the plastic film, a drying of the coating agent or, respectively, ink in a standard way is required, this making an evaporation of the solvent necessary given the employment of solvent-containing inks and making the elimination of the water part necessary given the employment of hydrous coating agents or, respectively, water soluble inks that ensues here. This drying expediently ensues due to the application of heat from the coated or, respectively, printed side, as a result whereof the thermal energy required for drying can be reduced to a minimum.

Care must be exercised during this drying to see that the film is to be heated to a temperature in its surface region whereat a reaction of agent or, respectively, colorant particles with particles of the plastic occurs in order to assure a durable adhesion of the coating or, respectively, of the printed format. On the other hand, care should be exercised to see that the heating is definitely not carried out to a point above the temperature of the loss of shape stability of the plastic film.

When a printing process is not to be followed by a second printing process, then it is recommendable in view of the removal of the printed and dried plastic film from the substrate to undertake an at least partial cooling of the film for the required cooling of the film before the removal, so that the removal can already occur under the influence of tensile forces without modifying the printed format due to potential elongation of the film. The same is true of a one-time coating and the removal of the film from the substrate that is then required.

On the other hand, however, the cooling can also ensue after the removal from the substrate.

For coating or, respectively, printing plastic films hauled off from a supply reel, i.e. for great quantities of plastic, it is recommendable to deposit the film on a live substrate that simultaneously represents the conveying medium for the plastic film.

The live substrate is a matter of a continuously circulating, heat resistant, special conveyor belt. A roller member can be utilized instead of an endless conveyor belt for the transfer printing process according to claims 13 and 14 and 19–22. A roller member merely offers the further advantage that it can be simultaneously employed for the transfer printing in that the printing format to be printed onto the film is applied onto a sub-region of the roller and is transferred therefrom onto the film when the film runs thereover.

For example:

soft PVC films having a thickness from 0.01–5 mm, hard PVC and PVC-ABS films having a thickness of 0.01–0.5 mm, foamed films having a thickness of 1–3 mm can be printed, lacquered, coated, laminated and embossed with the assistance of the inventive method.

What is claimed is:

1. A method for providing a coating or printing on a plastic foil or film, said method comprising the steps of:

providing an endless conveyor belt having a conveying surface;

depositing a plastic foil or film on said conveying surface;

adhering the plastic foil or film to the conveying surface by heating the plastic foil or film to a temperature sufficient to adhere the plastic foil or film to the conveying surface to provide an adhered foil or film;

cooling the adhered foil or film;

coating a surface of the adhered foil or film opposite the conveying surface with a coating composition to provide a wet coated foil or film;

heating the wet coated foil or film to provide a dry coated foil or film;

cooling the dry coated foil or film; and thereafter, removing the cooled dry coated foil or film from said conveyor belt.

2. A method as defined in claim 1, wherein said coating composition is selected from the group consisting of aqueous coatings, solvent-containing coatings, a mixture of aqueous and solvent containing coatings, UV-curable lacquers, inks and PVC pastes.

3. A method as defined in claim 2, wherein said solvent-containing coatings include an organic solvent.

4. A method as defined in claim 3, wherein said organic solvent is selected from the group consisting of methanol, ethanol, isopropanol, xylol, 1-butanone, methyl ethyl ketone, dimethylformamide, methyl glycol acetate, tetrahydrofuran and mixtures of any of the foregoing.

5. A method as defined in claim 1, wherein said conveyor belt is made from aramid, polyamide, mixed polyester fabric, fleece or felt.

6. A method as defined in claim 1, wherein said conveyor belt is a coated conveyor belt coated with rubber or a thermoplastic polymer.

7. A method as defined in claim 1, wherein said conveying surface has a release layer thereon.

8. A method as defined in claim 7, wherein said release layer comprises a release agent selected from the group consisting of silicone and polytetrafluoroethylene (PTFE) release agents.

9. A method as defined in claim 1, wherein said depositing step includes blowing the plastic foil or film against the conveying surface with air.

10. A method as defined in claim 1, wherein said depositing step includes suctioning the plastic foil or film against the conveying surface with vacuum.

11. A method as defined in claim 1, further comprising the step of preheating the plastic foil or film to relax internal stresses therein prior to said depositing step.

12. A method as defined in claim 1, wherein said plastic foil or film is heated or cooled in said depositing and drying steps from a side opposite said conveying surface.

13. A method as defined in claim 1, wherein said adhered foil or film and said dry coated foil or film are heated or cooled in said heating or cooling steps, respectively, from a side opposite said conveying surface.

14. A method as defined in claim 1 wherein in the depositing step, the plastic foil or film is a heated plastic foil or film.

15. A method as defined in claim 1, wherein said conveying surface is embossed or shagreened for embossing the plastic foil or film in said adhering step.

16. A method as defined in claim 1, further comprising the step of transferring the plastic foil or film to an embossing belt and embossing the foil or film after said removing step.

17. A method as defined in claim 1, further comprising the step of contacting the adhered plastic foil or film with an embossing surface to emboss the plastic foil or film prior to said removing step.

18. A method as defined in claim 1, wherein said coating step and said drying step are repeated in sequence prior to said depositing step to provide a plurality of dry coatings on said conveying surface.

19. A method for providing a transfer coating on a plastic foil or film comprising the steps of:

providing an endless conveyor belt having a conveying surface;

applying a coating composition on said conveying surface to provide a wet coated conveying surface;

drying the coating composition on the wet coated belt to provide a dry coated conveying surface;

providing a supply of preheated plastic foil or film;

depositing said preheated plastic foil or film on said dry coated conveying surface to provide a deposited foil or film;

heating the deposited foil or film to a temperature of from about 160° to about 250° C. to react the deposited foil or film and dry coating to durably adhere the dry coating to the deposited foil or film to provide a heated transfer coated foil or film;

cooling said heated transfer coated foil or film to provide a cooled transfer coated foil or film; and thereafter, removing said cooled transfer coated foil or film from said conveyor belt.

20. A method as defined in claim 19, wherein during said heating step said deposited foil or film is blown against the conveying surface with air.

21. A method as defined in claim 19, wherein during said heating step said deposited foil or film is suctioned against the conveying surface with vacuum.

22. A method as defined in claim 19, further comprising the step of transferring the cooled transfer coated foil or film to an embossing belt and embossing the cooled transfer coated foil or film after said removing step.

23. A method as defined in claim 19, further comprising the step of contacting the adhered plastic foil or film with an embossing surface to emboss the deposited plastic foil or film prior to said removing step.

24. A method as defined in claim 19, wherein said applying step and said drying step are repeated in sequence prior to said depositing step to provide a plurality of dry coatings on said dry coated conveying surface.

25. A method as defined in claim 24, wherein the dry coatings in said plurality of dry coatings are the same composition.

26. A method as defined in claim 24, wherein the dry coatings in said plurality of dry coatings include different compositions.

27. A method as defined in claim 19, wherein during said heating step the deposited foil or film is contacted with an embossing surface to provide an embossed heated transfer coated foil or film.

28. A method as defined in claim 27, wherein said embossing surface is said conveying surface.

29. A method for providing a transfer coating on a substrate comprising the steps of:

providing an endless conveyor belt having a conveying surface;

applying a coating composition on said conveying surface to provide a first wet coating layer on said conveying surface;

drying said first wet coating layer to provide a dry coated conveying surface;

applying at least one further coating composition on said dry coated conveying surface to provide a wet coated conveying surface;

providing a supply of a substrate selected from the group consisting of tricot, fabric, fleece and felt;

depositing said substrate on said vet coated conveying surface;

heating the substrate to gel and dry the wet coating composition to provide a coated substrate;

cooling the coated substrate; and thereafter, removing the coated substrate from the conveyor surface.

* * * * *